United States Patent [19]

Ganter et al.

[11] 4,045,954

[45] Sept. 6, 1977

[54] SAFETY MECHANISM FOR A WATERTIGHT WATCH HAVING A PIEZO ELECTRIC BUZZER

[75] Inventors: Wolfgang Ganter, Schramberg; Albert Ginter, Lauterbach, both of Germany

[73] Assignee: Gebruder Junghans GmbH, Schramberg, Wurttemberg, Germany

[21] Appl. No.: 653,623

[22] Filed: Jan. 29, 1976

[30] Foreign Application Priority Data

Jan. 30, 1975 Germany ..... 7502725[U]

[51] Int. Cl.[2] ..... G04C 21/02; G04C 21/34; G04B 23/12; G08B 3/10

[52] U.S. Cl. ..... 58/38 R; 58/57.5; 340/384 E

[58] Field of Search ..... 58/19 R, 38, 57.5, 152 B; 340/384 R, 384 E, 388, 391; 310/8.9, 9.1

[56] References Cited

U.S. PATENT DOCUMENTS

| | | | |
|---|---|---|---|
| 3,530,463 | 9/1970 | Spadini et al. | 340/384 R |
| 3,788,060 | 1/1974 | Kawamura | 58/38 |
| 3,879,931 | 4/1975 | Yasuda | 58/57.5 |
| 3,974,499 | 8/1976 | Shigemori et al. | 340/384 E |

FOREIGN PATENT DOCUMENTS

| | | |
|---|---|---|
| 2,215,768 | 3/1972 | Germany |

*Primary Examiner*—E. S. Jackmon
*Attorney, Agent, or Firm*—Burns, Doane, Swecker & Mathis

[57] ABSTRACT

A watch of the watertight type has a housing including a downwardly apertured housing portion for transmitting sound. A diaphragm is attached to the housing in a manner effecting a watertight seal. The diaphragm is capable of flexure toward and away from the apertured housing portion. A piezo electric buzzer element is secured internally of the diaphragm and is responsive to electrical excitation for producing a buzzing sound. An electrical circuit is connected to the piezo element for electrically exciting the piezo element. A safety mechanism is provided for preventing an excessive amount of flexure of the diaphragm in response to pressure acting thereon. A first safety element is secured to the diaphragm. A second safety element is secured to the housing. The first safety element is movable, with the diaphragm, relative to the second safety element in an inward direction away from the apertured housing portion. The second safety element includes a stop for contacting the first safety element to limit the amount of flexure of the diaphragm.

7 Claims, 3 Drawing Figures

SAFETY MECHANISM FOR A WATERTIGHT WATCH HAVING A PIEZO ELECTRIC BUZZER

BACKGROUND AND OBJECTS

This invention concerns a watertight watch with a piezo electric buzzer mechanism and a safety arrangement in order to prevent a lasting deformation or a destruction of a diaphragm in case of too great a load through pressure or thrust. The watch is preferably of the type whose housing bottom has outlet openings for transmitting sound, on the inside of which housing bottom the piezo element has been disposed in a manner functioning additionally as a sealing element.

Through German Pat. No. 2,215,768, especially through FIG. 7 thereof, a watch with an electronic alarm has been known which comprises the above-recited features. In such a watch, a carrier plate has been provided as a safety element, the plate being disposed at a slight distance from the diaphragm. The plate is intended to prevent any unduly high pressure acting on the diaphragm from deforming the diaphragm excessively or damaging it. Such a carrier plate is disposed in close proximity to the diaphragm. The plate has, however, the disadvantage that it takes up too much space for one thing, and for another, that in case of too great an amplitude of the axial oscillation movement of the diaphragm and piezo element, the latter can be damaged or destroyed as a result of too frequently striking against the carrier plate.

Therefore, it is an object of the invention to create in connection with a watertight watch having a diaphragm functioning also as a sealing element, an economical and easily installable device which protects the diaphragm against lasting deformation or destruction. Such protection can, for example, be effective during a check for watertightness by forces which are multiple times the usual pressure. Moreover, it is another object that an effective limitation of the amplitude of diaphragm movement be achieved in both directions of oscillation.

BRIEF DESCRIPTION

These objects will be solved by the present invention as described and claimed hereinafter. More particularly, the present invention relates to a safety mechanism disposed within a watch. The watch is preferably of the watertight type having a housing including a downwardly apertured housing portion for transmitting sound. A diaphragm is attached to the housing in a manner effecting a watertight seal. The diaphragm is capable of flexure away from the apertured housing portion. A piezo electric buzzer element is secured internally of the diaphragm and is responsive to electrical excitation for producing a buzzing sound. An electric circuit is connected to the piezo element for electrically exciting the latter. The safety mechanism is intended to prevent an excessive amount of flexure of the diaphragm in response to pressure acting thereon. The safety mechanism includes a first safety element secured to the diaphragm and a second safety element secured to the housing. The first safety element is movable, with the diaphragm, relative to the second safety element in an inward direction away from the apertured housing portion. The second safety element includes a stop for contacting the first safety element to limit the amount of flexure of the diaphragm.

THE DRAWINGS

In the following pages, two preferred embodiments of the invention are described in more detail in which.

DETAILED DESCRIPTION

Figure 1:
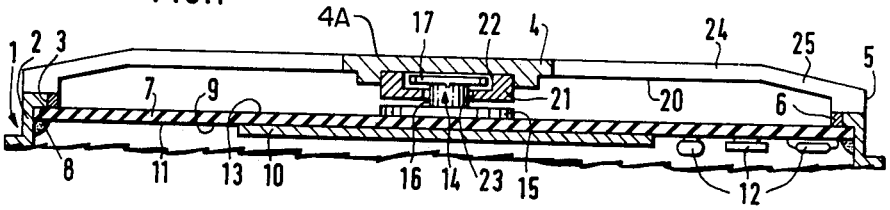
FIG. 1 shows a section through a lower portion of a watch along the line I—I in FIG. 2, depicting a first preferred embodiment of the invention.
Figure 2:
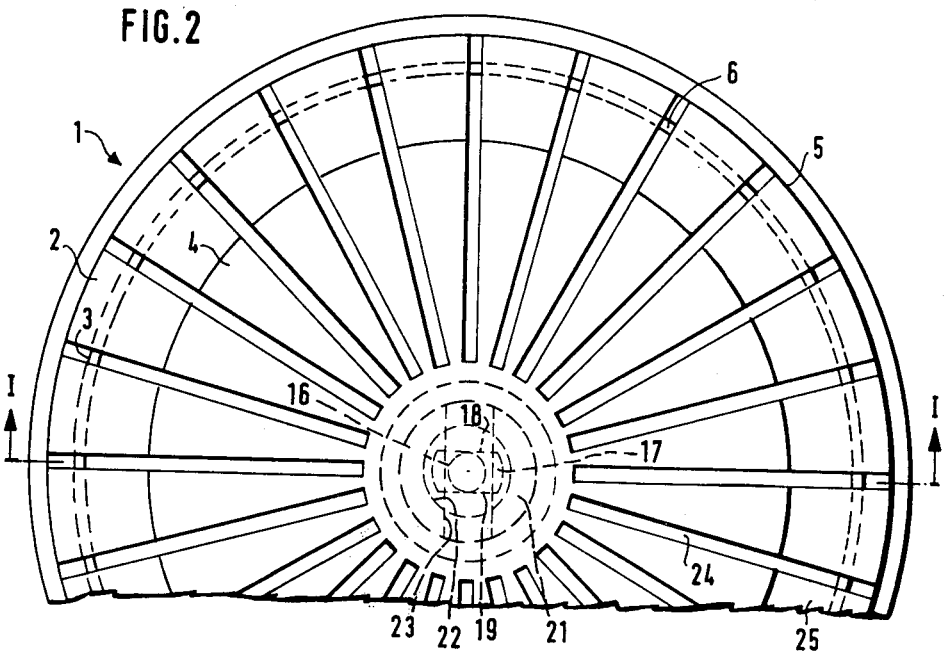
FIG. 2 is a view of the watch from below.
Figure 3:
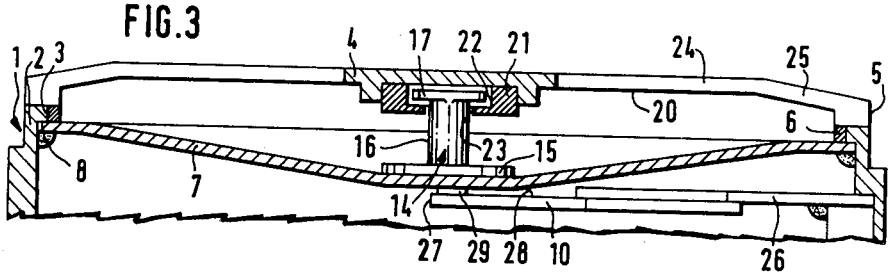
FIG. 3 is a sectional view taken similar to that of FIG. 1 but depicting a second preferred embodiment of the invention.

In FIGS. 1, 2 and 3, the numeral 1 designates a housing portion in a lower portion of a watch which has been inverted for purposes of this discussion. The housing 1 has an outside wall 2, which has been broadened at its lower end into a holding edge 3. The edge 3 projects radially into the inside of the housing. The housing bottom unit 4 includes a circular primary bridge 5 which rests on said holding edge 3. The bottom unit 4 also includes a center section 4A. The bridge 5 is axially spaced from the plane of the center section 4A, i.e., is non-coplanar relative thereto. The bridge 5 thus constitutes the outside peripheral limitation of the bottom unit 4. A likewise circular secondary bridge 6 is molded onto the primary bridge 5 to form an axial extension of the latter. The secondary bridge 6 has a small outside diameter and fits inside against the holding edge 3 of the housing wall 2. The secondary bridge 6 thus causes a centering of the housing bottom unit 4 and makes possible a good attachment to the housing wall. The connection of these two components can be achieved by frictionally press-forming, or by positive connection via glueing, or by fitting together in shape as by screwing-in-via threaded connections.

The numeral 7 designates a diaphragm which fits against the inside planar or surface 8 of the holding edge 3. The diaphragm at its outer periphery is glued to the holding edge 3 as well as to the housing wall 2. The diaphragm is thus able to flex in directions toward and away from the bottom unit 4. More particularly, as the piezo element is excited, the diaphragm will oscillate in an axial direction. The diaphragm 7 comprises electrically insulating material and carries on its first or inner planar surface 9 a conventional piezo element 10 in the form of a round lamella. This round piezo element has one entire surface glued to the inner diaphragm surface 9, and is thus secured internally of the diaphragm. Moreover, a printed circuit 11 for the buzzer with the usual conventional electronic components 12 is also attached to the inner plane surface 9. Reference may be had to U.S. Pat. No. 3,788,060, incorporated herein by reference, for a more detailed description of such circuitry.

At the center of a second planar surface 13 of the diaphragm 7, a safety bolt 14 is rigidly attached. This safety bolt 12 has a foot 15 in the shape of a circular disk which is disposed coaxially with the housing bottom unit 4. A cylindrical pin 16, with a smaller diameter than the foot 15, extends from the foot in an axial direction. An elongate head 17 has been molded onto the upper end of the pin 16. The head 17 consists of a plate with parallel flat lateral edges 18 and 19, their mutual distance corresponding to the diameter of the cylindrical pin 16.

As a counter-piece to the safety bolt 14, a counter plate 21 has been attached on an inside surface 20 of the housing bottom 4. This counter plate 21 has a circular recess 22, the diameter of which is somewhat larger than that of the head 17 of the safety bolt. The depth of the recess is determined in accordance with the size of the standard oscillation amplitude of the diaphragm less the height of the head 17. A symmetrically arranged elongate groove 23, is molded in the side of the counter plate 21 and extends parallel to the recess 22. The groove 23 leads into the recess 22. The groove 23 is somewhat larger than the distance of the two lateral edges 18 and 19 of the head 17.

In the following paragraphs, the manner of mounting the diaphragm with the safety bolt attached thereto, will be described.

The diaphragm 7 is slipped into the housing 1 of the watch. At the same time, it must be aligned so that the head 17 of the safety bolt 14 can be slipped simultaneously through the parallel groove 23 into the recess 22 of the counter plate 21. Then the diaphragm, and thus at the same time, the head 17 is rotated simultaneously about the axis of the safety bolt 14 by 90° vis-a-vis the parallel groove 23 in the counter plate 21. Now the head 17 of the safety bolt can move axially in the space of the groove 22 of the counter plate 21.

The diaphragm 7 is connected by glueing to the holding edge 3 and the housing wall 2. By selecting suitable materials for the diaphragm and adhesive, and by effecting an exact glueing together of the diaphragm and the housing, no additional sealing element will be required.

The safety arrangement, made up of the safety bolt 14 and counter plate 21, guarantees a sufficient protection of the diaphragm in case of the watertightness test. In such a test, the watch is subjected to pressure of an intensity which is multiple times that of pressures which commonly act upon the watch. This test pressure acts on the surface of the diaphragm to flex the diaphragm inwardly away from the bottom unit 4. Excessive flexure is prevented as a result of the head 17 contacting the bottom of the recess 22 and transferring pressure to the bottom unit 4. Without a safety arrangement, either the watertightness test cannot be carried out precisely, or else the diaphragm will be too greatly deformed by the test pressure, which can ultimately lead to permanent damage or destruction.

A number of outlet openings 24 for the sound are formed in the housing bottom 4, through which the produced sound can escape outwards. To prevent the entire surface of the housing bottom from having to engage the arm of the person carrying the watch, the housing bottom unit 4 includes a slanting facet 25 disposed on the outside peripheral area, as a result of which the volume intensity of the emerging sound is increased.

A second embodiment of the invention is shown in FIG. 3. Similar construction units as well as partial elements of them, have been designated by the same reference numbers as in the embodiments according to FIGS. 1 and 2.

In this case, the flexible diaphragm 7 is not developed as a planar plate but rather in the form of a flat funnel or dish-shaped member. The material for the diaphragm can be, for example, thin sheet metal of copper-beryllium. The piezo element, in case this embodiment is not attached to the diaphragm and, contrary to the round shape of FIG. 1, it has in this case a square shape. The square piezo element has three corners thereof glued onto three corners of a support 26, disposed separately in the housing of the watch. The fourth corner of the support 26 is secured to the housing in cantilever fashion. The fourth corner 27 of the piezo element 10 carries a small pin 29 on the side 28 thereof facing the diaphragm. This pin can comprise steel. The piezo element 10 is located on the attaching plate 26 so that it fits with its fourth corner 27 having the pin 29 approximately at the center of the diaphragm under pressure against, i.e., biased into contact with the center of the diaphragm. The piezo element is thus secured internally of the diaphragm.

In case of this arrangement (FIG. 3) the electric circuit is not attached to the diaphragm, because of the conductive material of the latter. But it is conceivable to develop the attaching plate 26 as a carrier of the electric circuit, including its electrical components and conducting paths. Such an expedient would be apparent to one skilled in the art and need not be explained further here.

The safety arrangement for guarding against unduly high pressure is in the case of this embodiment (FIG. 3), developed similarly to FIG. 1. In this case, and because of the funnel shaped diaphragm 7, an extended, i.e., longer, cylindrical pin 16 of the safety bolt 14 will be necessary. All other construction units or partial elements correspond to those of the embodiment according to FIGS. 1 and 2. Also, the function thereof is similar.

As a result of the use of such a previously described safety arrangements in a watch, its load capacity for pressure will be guaranteed beyond a normal measure. In case of too heavy a load, e.g. in case of submersion to unduly great depths of water, the force acting on the diaphragm is transferred to the housing bottom. The safety bolt and the counter plate, in this case, will prevent a deformation of the diaphragm beyond the elastic area, and will guarantee that the diaphragm, after removal of the load, can again return to its normal position without lasting damage.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a watch of the watertight type having housing means, including a downwardly apertured portion for transmitting sound; a diaphragm attached to said housing means in a manner effecting a watertight seal, said diaphragm being capable of flexure toward and away from said apertured housing portion; a piezo electric buzzer element secured internally of said diaphragm and being responsive to electrical excitation for producing a buzzing sound; electrical circuit means connected to said piezo element for electrically exciting said piezo element; and safety means for preventing an excessive amount of flexure of said diaphragm in response to pressure acting thereon; the improvement wherein said safety means comprises:

a first safety element secured to said diaphragm; and a second safety element secured to said housing means;

said first safety element being movable, with said diaphragm, relative to said second safety element in an inward direction away from said apertured housing portion;

said second safety element including stop means for contacting said first safety element to limit the amount of flexure of said diaphragm.

2. A watch according to claim 1 wherein said first safety element comprises a safety bolt, and said second safety element comprises a counter plate having a recess which receives said safety bolt.

3. A watch according to claim 2 wherein said safety bolt is attached rigidly to an outer surface of said diaphragm and said counter plate is rigidly attached to an inside surface of said apertured housing portion.

4. A watch according to claim 2 wherein said safety bolt includes a foot in the shape of a round disk, a cylindrical pin projecting from said foot and having a smaller diameter than said foot; and a head disposed at an outer end of said pin, said head having a pair of parallel edges; said head having a dimension parallel to said edges which is smaller than the diameter of said recess; the distance between said edges corresponding generally to the diameter of said pin.

5. A watch according to claim 4 wherein said counter plate comprises a round disk having a cylindrical recess opening toward said apertured housing portion and a groove communicating with said recess and opening toward said diaphragm; said recess and said groove being dimensioned to allow said head of said safety bolt to be slid through said groove and into said recess so as to be locked therein in response to rotation of said bolt by 90°.

6. A watch according to claim 1 wherein said second safety element includes an elongate groove and said first safety element includes an elongate projection which can be inserted through said groove and locked therein by rotation of said projection by 90°.

7. A watch according to claim 1 wherein said diaphragm is funnel-shaped; a support being mounted in said housing means; said piezo element being square and being attached at three corners to said support; the fourth corner of said piezo element carrying a pin which is biased against the center of said diaphragm.

* * * * *